US006840506B2

(12) United States Patent
Siivonen

(10) Patent No.: US 6,840,506 B2
(45) Date of Patent: Jan. 11, 2005

(54) MOTORCYCLE STAND FOR MAINTENANCE

(76) Inventor: Mika Siivonen, Riihenvainiontie 4, FIN-27320 Ihode (FI)

( * ) Notice: Subject to any disclaimer, the term of this patent is extended or adjusted under 35 U.S.C. 154(b) by 0 days.

(21) Appl. No.: 10/312,524

(22) PCT Filed: Jun. 29, 2001

(86) PCT No.: PCT/FI01/00623

§ 371 (c)(1),
(2), (4) Date: Dec. 27, 2002

(87) PCT Pub. No.: WO02/02454

PCT Pub. Date: Jan. 10, 2002

(65) Prior Publication Data

US 2003/0141493 A1 Jul. 31, 2003

(30) Foreign Application Priority Data

Jun. 30, 2000 (FI) ..... 20001559

(51) Int. Cl.[7] ..... B66F 3/00
(52) U.S. Cl. ..... 254/131
(58) Field of Search ..... 211/22, 17; 254/131, 254/120, 8 R, 94, 1; 248/352, 354.1, 354.5

(56) References Cited

U.S. PATENT DOCUMENTS 4,348,010 A * 9/1982 Baxter ..... 254/131
6,488,157 B2 * 12/2002 Chen ..... 254/131
6,581,784 B1 * 6/2003 Pino ..... 254/131

* cited by examiner

*Primary Examiner*—Robert C. Watson
(74) *Attorney, Agent, or Firm*—James C. Lydon

(57) ABSTRACT

The invention relates to a service stand (1), which is positioned beneath the rear part of a motorcycle and which extends from there to both sides of the motorcycle, the service stand having a lever member (2) for lifting the rear part of the motorcycle so that the rear wheel (3) is lifted off the ground (4), and members for connecting the service stand (1) to the rear part of the motorcycle. According to the invention the service stand (1) placed beneath a motorcycle leaning on its side stand has a connecting member (5), on the opposite side from the side stand, the connecting member being pre-adjustable in the height direction, whereas the height position of the connecting member (6) on the same side as the side stand can be adjusted in the height direction by the lever member (2).

15 Claims, 4 Drawing Sheets

MOTORCYCLE STAND FOR MAINTENANCE

This invention relates to a motorcycle service stand and particularly to a service stand, which may be positioned beneath the rear part of a motorcycle and which extends from there to both sides of the motorcycle, and quite particularly to such a service stand having a lever member for lifting the rear part of the motorcycle so that the rear wheel is lifted off the ground, and members for connecting the service stand to the rear part of the motorcycle for the lifting action.

Numerous different service stands for motorcycles are previously known. However, common to all of them is that the motorcycle must be kept in an upright position for the lifting action.

Thus, it is known e.g. from the JP patent 62290698 a servicing rack arranged on wheels and provided with a hydraulic lifting device, where the rack is pushed next to the rear wheel of the motorcycle which is kept upright, and the rear wheel is provided with a hollow nave. The upper end of a vertical piston in the lifting device has a peg, which projects at a right angle from the piston and which fits in the hollow nave of the motorcycle, so that when a pressure is pumped into the hydraulic cylinder the piston and the peg projecting from it are raised, and they lift the rear part of the motorcycle upwards, so that the rear wheel comes off the ground. A disadvantage here is, like in all other service racks designed for this purpose, that the motorcycle must be kept upright already before the lifting is begun.

This is a problem particularly when only one person takes care of the service action and thus of the lifting. A motorcycle supported by its side stand is leaning to one side, and its rear part could not be lifted in this position, but the motorcycle must be first raised into the upright position and it must be kept in this position when the service rack is attached to it. However, a motorcycle is heavy to keep upright, and if the same person at the same time must arrange the service rack beneath the rear wheel of the motorcycle and possible fasten it to the motorcycle there is an apparent risk that the motorcycle turns over before it is supported by the service rack or fastened to it.

The object of the present invention is to obviate this disadvantage and to provide a motorcycle service stand of the type mentioned in the introductory part, which even one person can safely and easily use, and which nevertheless has a simple and advantageous structure.

The main characteristics of the invention appear in the enclosed claims.

The present invention is based on the perception that the service stand can be fastened to a motorcycle supported by its side stand, when a connecting member on the opposite side of the motorcycle regarding the side stand is already adjusted to the final lifting height as it is backed up or fastened to the rear part of the motorcycle, whereby it is only necessary to lift the connecting member on the same side as the side stand of the motorcycle, with the aid of the lever member or the like, to the same height as the connecting member on the opposite side. Thus it is not necessary to raise the motorcycle to the upright position in advance and to support it before the service stand is connected to the motorcycle. Even one person is able to safely arrange the service stand in its place and to remove it, and to lift and lower the rear part of the motorcycle.

In a favourable embodiment of the invention the connecting members are substantially vertical guide members in the service stand, such as rods which can be telescopically moved along tubes, which rods at the upper end have members for supporting the rear part of the motorcycle and possibly to be fastened to the motorcycle. This is a structurally simple solution for realising the height adjustment.

In one embodiment a support member of this kind is a supporting bar which can be slipped through the hollow nave of the rear wheel of the motorcycle and which at its ends is supported by the vertically adjustable rods of the service stand. Advantageously the supporting bar can be locked to one of these rods, such as to the vertically pre-adjustable rod. This embodiment utilises the fact that the nave of motorcycle rear wheels is often hollow.

In another favourable embodiment of the invention the connecting member of the service stand is located on the same side as the side stand of the motorcycle and the connecting member can be lifted with the aid of the lever member, and it is provided with a locking device which locks the upper end of the connecting member to the same height as the upper end of the pre-adjusted connecting member on the opposite side. In this embodiment the member, such as a tube, which guides the substantially vertical rod and which is connected to the lever member, has a catch at one end which can turn around an axis projecting at a substantially right angle from the member. At one side edge of the catch a slot is opening advantageously at an angle towards its rotation axis for receiving the peg projecting from said vertical rod. The opposite end of the catch is also chamfered towards the slot in order to force the catch to turn around its axis as the peg is lifted, until the peg hits the slot and is locked into it due to the load acting on the rod.

In order to release the locking and to lower the rear part of the motorcycle to the ground there is between the slot and the axis of the catch a turning blocking plate, which is articulated at one end and which can turn in the plane of the catch. When the peg of the rod is lifted to the level of the slot it will, raised by the peg, allow the peg to enter the slot, but when the rod is lifted still higher and as the peg leaves the slot, then the blocking plate turns by its own weight in front of the slot and prevent the lowered peg from re-entering the slot. In other words, in order to release the catch you only have to use the lever member to lift with the rod of the connecting member on the same side past its locking position, and then it can be lowered to its lowest position where the rear wheel of the motorcycle rests on the ground and the motorcycle again leans, supported by its side stand.

The other end of the lever member can be advantageously connected to the lower part of the rod of the service stand on the same side as the side stand of the motorcycle at such a distance from the upper end of the rod that it is, when the rod is in its locked position, substantially at the same level as the upper end of the pre-adjusted rod. In this way the motorcycle can be moved into its upright position when its rear part is raised and the rear wheel is off the ground, which is advantageous regarding the service work.

The vertical rods of the service stand are advantageously provided with holes at equal mutual distances in their longitudinal direction for cotter pins or the like. With the aid of them the rod of the fastening member on the opposite side of the service stand in relation to the side stand of the motorcycle can be locked into its guide member at such a height that it on this side supports the motorcycle leaning on its side stand. On the other side the end of the lever member can be connected, on the same side as the side stand, to the lower end of the rod of the connecting member at such a height that when said rod is raised and locked its upper end is substantially at the same height as the pre-adjusted rod on the opposite side, whereby the rear wheel of the motorcycle is off the ground.

The lever member is advantageously a two-armed lever and its support point is in the service stand, whereby the end of the shorter arm of the lever member is connected at a suitable height to the lower part of the rod connecting member on the same side as the side stand of the motorcycle. Advantageously it is connected to the locking peg of said rod, the position of the peg being adjustable in the longitudinal direction of the rod in the above mentioned way.

Instead of the supporting bar arranged through the hollow nave of the rear wheel of the motorcycle the lifting can be made by the brackets on the upper ends of the rods of the connecting members in the service stand, so that the brackets grip the pegs projecting to both sides of the rear part of the motorcycle, or which brackets extend beneath the rear part of the motorcycle, such as beneath the rear fork.

The invention is described below in more detail with reference to the enclosed drawings, in which.

Figure 1:
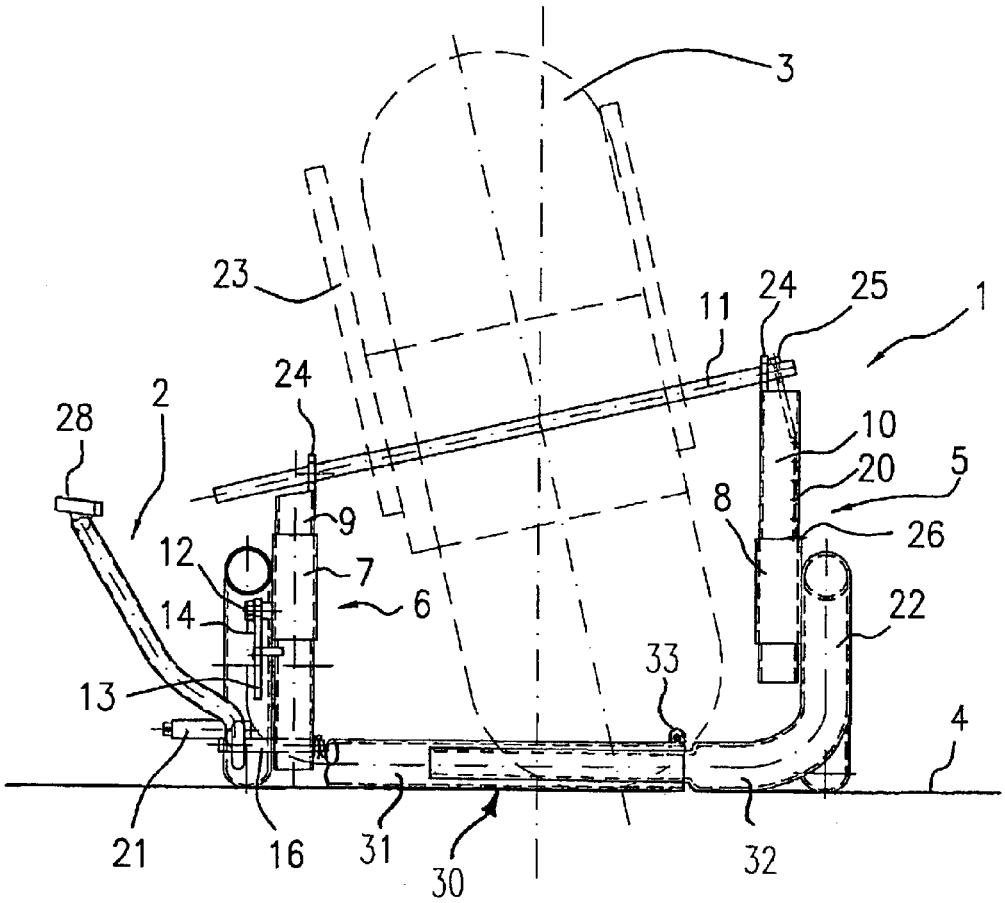
FIG. 1 shows a partially cut view of a favourable embodiment of the invention fastened to the rear wheel of a motorcycle, seen from behind the motorcycle.
Figure 2:
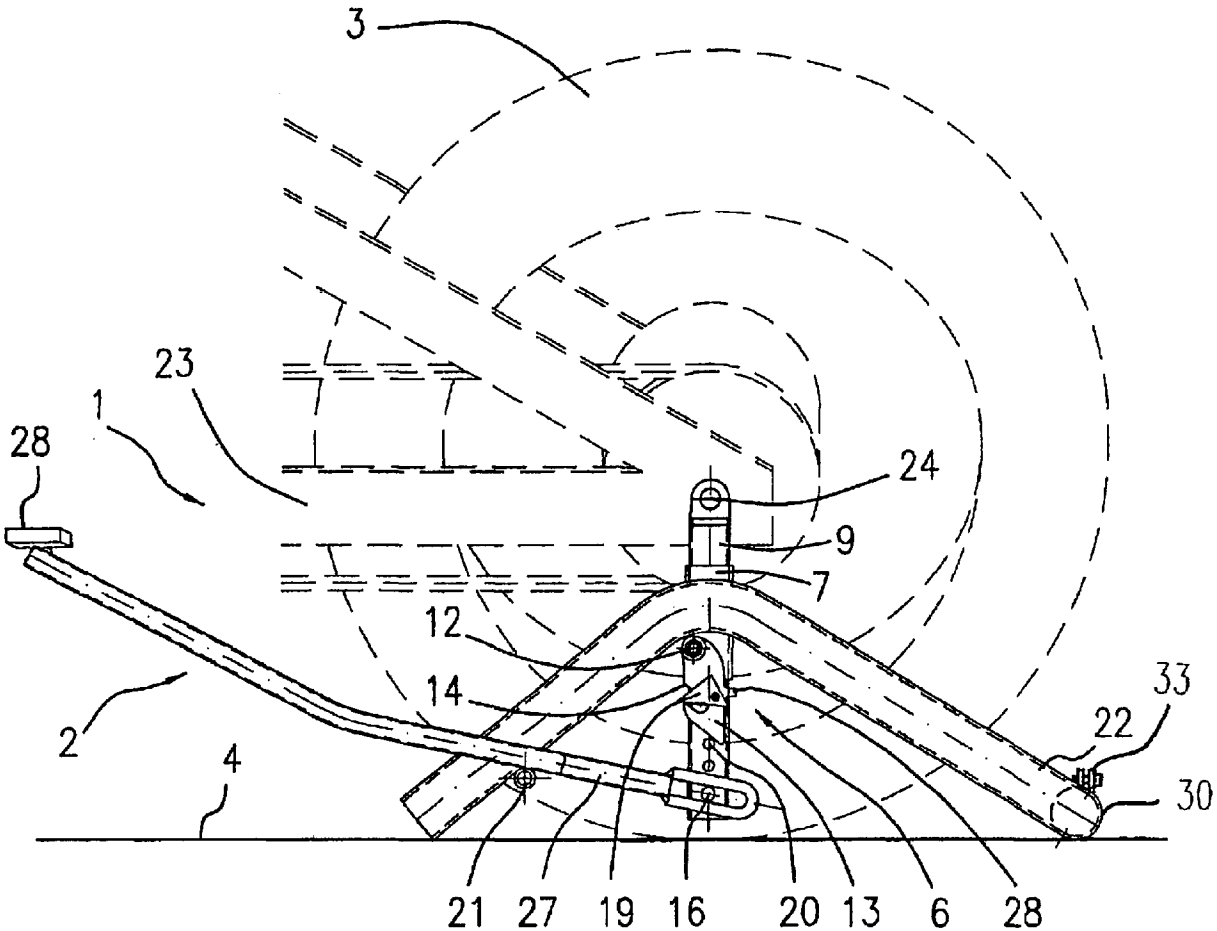
FIG. 2 shows the same embodiment as in FIG. 1 and in the same situation, but seen from the side of the side stand of the motorcycle.
Figure 3:
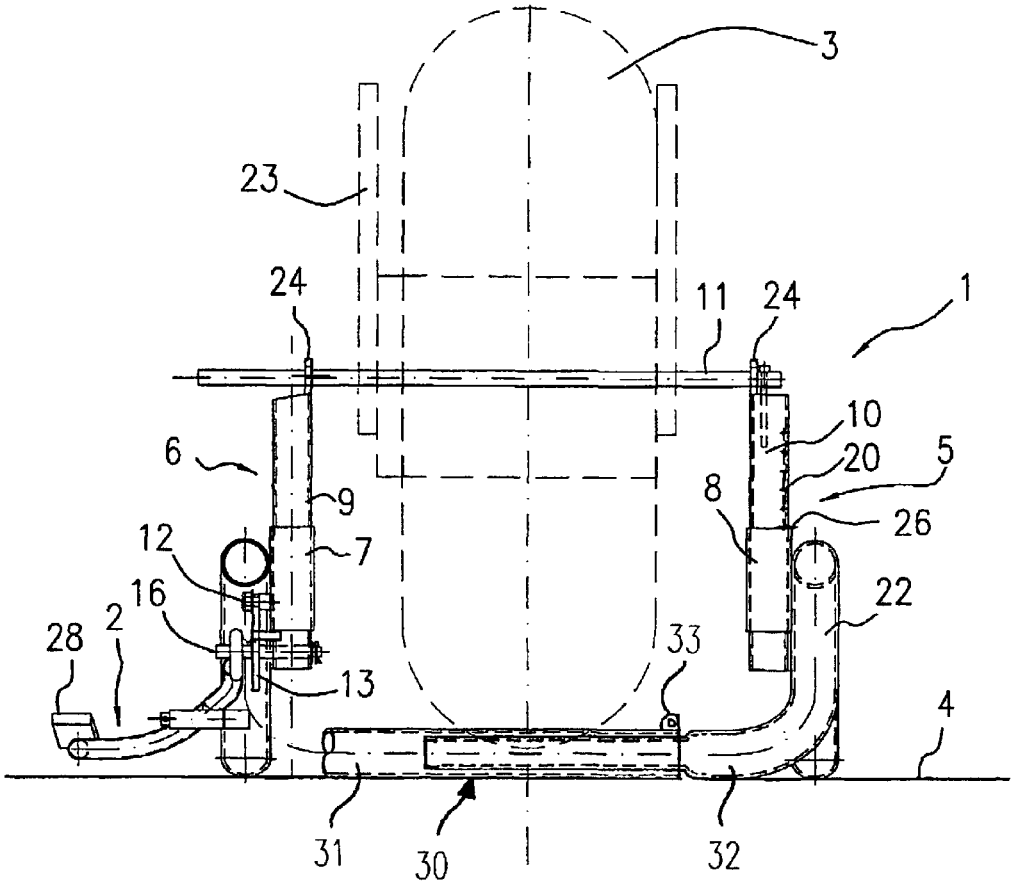
FIG. 3 shows the same embodiment as in FIG. 1, but as the rear wheel of the motorcycle being raised off the ground.

In FIGS. 1 to 3 the reference numeral 1 represents the service stand in general and the reference numeral 22 represents its tube-like frame structure which is arranged beneath the rear part of a motorcycle, of which the FIGS. 1 to 3 show only the rear wheel 3 and in a suggestive way also the rear fork 23. It is seen that the frame structure 22 extends from beneath the rear wheel 3 on both sides of the rear part of the motorcycle, whereby its both sides are connected by a transversal tube 30, which is formed by two tubes connected to each other in a telescopic manner, namely by an outer tube 31 and an inner tube 32 which extends within the outer tube (FIGS. 1 and 3). The inner tube 32 can be adjustably pushed into the outer tube 31 in order to adjust the width of the service stand, corresponding to the width of the motorcycle to be serviced, and after the adjustment the tubes 31 and 32 can be locked to each other with a locking member 33, which is arranged in the outer tube 31 and is locked into the inner tube 32.

The frame structure 22 has on its opposite sides two vertical guide tubes 7 and 8, and within which are rods 9 and 10, respectively, which can be telescopically moved in the vertical direction. For locking members, such as cotter pins or the like, there are holes 20 located in the rods 9 and 10 at equal mutual distances in the longitudinal direction of the rods. At the upper ends of the rods 9, 10 there are further lugs 24, through which the support bar 11 slipped through the hollow rear axis of the motorcycle can be arranged, whereby the support bar can be locked in its place with a pin 25 extending into the hollow rod 10. However, before that the rod 10 on the opposite side of the rear wheel 3 regarding the side stand of the motorcycle, has been lifted and locked with a cotter pin 26 at such a height that the support bar 11 can be slipped through the hollow nave of the rear wheel 3 and locked to the lug 24 at the upper end of the rod 10 with the locking peg 25. At the same time the lifting rod 9 on the opposite side has been lowered to such a height that the support bar 11 can be slipped through the lug 24 at its upper end.

Now the service stand is ready for lifting, and for this purpose it has a two-armed lever member 2 rotating around a support point 21 in the frame 22, the end of the shorter arm 27 in the lever member being adjustably fastened to the lower part of the lifting rod 9 with the aid of a locking peg 16. The lifting rod 9 can be lifted in its guide tube 7 by pressing the opposite end 28 of the lever member 2 downwards, so that finally the lugs 24 of the rods 9, 10 are substantially on the same level and the support bar 11 connecting them is roughly horizontal, whereby the rear wheel 3 of the motorcycle is off the ground 4 and the motorcycle in its upright position. In addition the lifting rod 9 can be locked in this position by a particular locking device, which is shown in more detail in the FIGS. 4 and 5.

Figure 4:
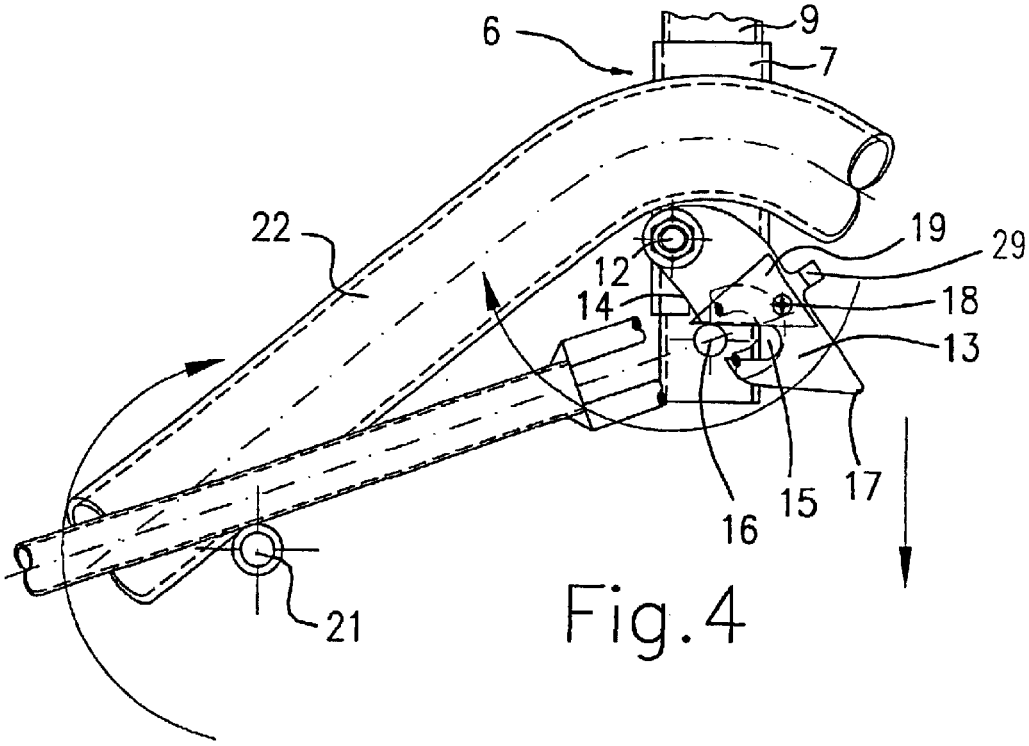
FIG. 4 shows a partial view of FIG. 3 when the locking is in process.

The above mentioned locking device comprises a plate-like catch 13 which is articulated at its upper end around the axis 12 directed substantially horizontally outwards from the service stand 1 into the guide tube 7 of the lifting rod 9 in the connecting member 6. At the other side edge 14 of the catch 13 there is a slot 15, whose mouth is closer to the axis 12 than its bottom, i.e. the slot 15 is at an angle to the longitudinal axis of the plate-like catch 13. The lower end 17 of the catch 13 is also chamfered towards the mouth of the slot. Due to this the locking peg 16 of the lifting rod 9, to which also the second end of the lever member 2 is fastened, will hit the chamfered end 17 of the catch 13 when the opposite end 28 of the lever member 28 is pressed downwards and the lifting rod 9 is raised, and then it forces the catch to turn around its axis 12 in front of the locking peg 16, until the locking peg is in the mouth of the slot 15 (FIG. 4). When the lever member 2 is now released and the lifting rod 9 with its locking peg 16 are slightly lowered, the plate-like catch 13 will turn back due to its own weight, whereby its slot 15 receives the locking peg 16, which is locked into the slot by the load acting against the lifting rod 9 and due to the inclined direction of the slot 15 downwards from its mouth.

In order to release the above described locking device the plate-like catch 13 has between its axis 12 and the slot 15, a blocking plate 19 which turns around a joint 18, which is in parallel with the axis 12, whereby the length of the blocking plate 19 is such that it extends at least to the mouth of the slot 15. The length of the blocking plate 19 is such that the locking peg 16 lifts it away from the position in front of the slot 15 as the locking peg is raised into the locking position, whereby it will not prevent the catch 13 from being locked to the locking peg 16, as is shown in FIG. 4.

Figure 5:
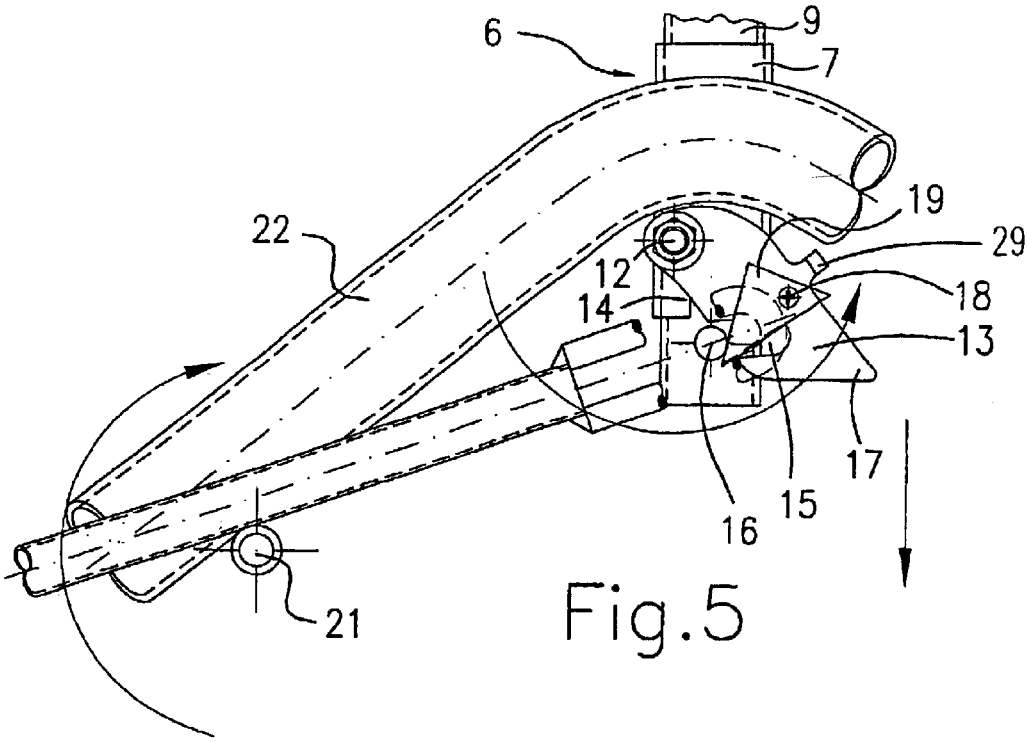
FIG. 5 shows the same view as FIG. 4 when the locking is released.

When after the service the lifting rod 9 is again slightly lifted with the aid of the lever member 2, the locking peg 16 of the lifting rod is removed from the slot 15 in the catch 13 and from below the blocking plate 19, whereby the plate will turn due to its own weight so that it blocks the mouth of the slot 15 of the catch 13. At the rear edge of the catch 13 there is a detent 29, which prevents the blocking plate 19 from turning past this blocking position (FIG. 5). Then the lifting rod 9 can be freely lowered with the aid of the lever member 2, as the blocking plate 19 prevents the locking peg 16 from entering the slot 15.

To a person skilled in the art it is obvious that the invention may be varied in wide limits within the scope defined by the claims below. Thus for instance the tube-like frame 22 of the service stand 1 can be provided with wheels or rolls in order to facilitate the moving of the service stand and any motorcycle on it. Instead of the two-armed lever the lever member 2 can be a hydraulic lifting device, which in addition to the lifting rod 9 can separately lift also the pre-adjustable rod 10. As a lifting point of the motorcycle it is also possible to use the front bearing point of the rear fork, the bottom surface of the frame, or projections and holes in the frame.

What is claimed is:

1. A service stand for a motorcycle having a front part, a rear part and two sides, the service stand being intended to be positioned beneath the rear part of the motorcycle and to extend from there to both sides of the motorcycle, the service stand comprising a lever member adapted to lift the rear part of the motorcycle, so that the rear wheel is lifted off the ground, and first and second connecting members for connecting the service stand to the motorcycle, wherein a height position of said first connecting member being pre-adjustable and said first connecting member is adapted to be connected to a side of said motorcycle opposite a side of said motorcycle having a side stand mounted thereon, and wherein said second connecting member is adapted to be connected to a side of said motorcycle having a side stand mounted thereon, and wherein a height position of the second connecting member is adjusted by the lever member.

2. The service stand of claim 1, wherein the first and second connecting members each include a guide tube.

3. The service stand of claim 2, wherein said guide tube includes a rod which is telescopically movable in a substantially vertical direction within said tube, said rod having an upper end for supporting the rear part of the motorcycle or for being connected to the the motorcycle.

4. The service stand of claim 3, further comprising a support bar adapted to be slipped through a hollow nave of a rear wheel of the motorcycle, and which is supported by the upper ends of the vertically movable rods of the guide tubes, wherein the support bar can be locked to at least one of the rods.

5. The service stand of claim 4, wherein the support bar can be locked to said rod of said guide tube of said first connecting member.

6. The service stand of claim 4, the second connecting member which is connected to the lever member of the service stand, has a catch, which at one end can rotate around a substantially horizontal axis, and which has a slot opening towards one of its side edges, adapted to receive a peg projecting from said vertically movable rod of its guide member, and that an opposite end of the catch is chamfered in its rotating direction towards said slot in order to force the catch to rotate around its axis in front of the peg as it rises until the peg hits the slot and is locked into it due to a load acting on the vertically movable rod.

7. The service stand of claim 6, wherein the catch has a blocking plate, which is articulated at one end and is located between the slot and the axis, and which can turn in the plane of the catch and which extends to a mouth of the slot, whereby, when the peg of the vertically movable rod rises to the level of the slot, the blocking plate will be lifted by the peg and allow the peg to enter the slot, but when the rod is further lifted and the peg leaves the slot, the blocking plate will due to its own weight turn in front of the slot to prevent the peg from re-entering the slot as the rod is lowered.

8. The service stand of claim 6, wherein an opposite end of the lever member is connected to a lower end of the rod of the second connecting member at such a distance from the upper end of the rod that in a locked upper position of the rod the upper end of the rod is substantially on the same level as the upper end of the rod of the first connecting member.

9. The service stand of claim 8, wherein the vertically movable rods of said guide tubes have in the vertical direction at equal distances holes to adjust the height position of the vertically movable rods.

10. The service stand of claim 3, further comprising a support point for the lever member, the support point separating the lever member into a shorter arm and a longer arm, wherein an end of said shorter arm of said lever member is connected at a suitable height to a lower part of the rod of said second connecting member.

11. The service stand of claim 10, wherein said end of the shorter arm is connected to a peg projecting from said rod.

12. The service stand of claim 3, further comprising fastening or supporting members comprising brackets at said upper ends of the rods of said guide tubes, which brackets are adapted to open upwards and fit into projections in a rear fork of the motorcycle, or comprise supporting surfaces which can be arranged beneath the rear fork.

13. The service stand of claim 1, further comprising a frame structure adapted to support said lever member and said first and second connecting members and comprising two sides, wherein said sides of its frame structure are connected together telescopically and that they can be locked to each other to adjust the width of the service stand.

14. The service stand of claim 6, wherein said slot opening opens towards one of its side edges at an angle to the axis of rotation of said catch.

15. The service stand of claim 9, wherein said holes of said rods are adapted to receive a pin.

* * * * *